US007663050B2

(12) United States Patent
Hiratsuka

(10) Patent No.: US 7,663,050 B2
(45) Date of Patent: Feb. 16, 2010

(54) AUTOMATIC ACCOMPANIMENT APPARATUS, METHOD OF CONTROLLING THE SAME, AND PROGRAM FOR IMPLEMENTING THE METHOD

(75) Inventor: Satoshi Hiratsuka, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 42 days.

(21) Appl. No.: 11/270,114

(22) Filed: Nov. 8, 2005

(65) Prior Publication Data

US 2006/0096446 A1 May 11, 2006

(30) Foreign Application Priority Data

Nov. 9, 2004 (JP) ..... 2004-325349

(51) Int. Cl.
*G10H 1/36* (2006.01)

(52) U.S. Cl. ..... 84/610; 84/609; 84/634; 84/649; 84/650; 84/666

(58) Field of Classification Search ..... None
See application file for complete search history.

(56) References Cited

U.S. PATENT DOCUMENTS 5,506,370 A * 4/1996 Nakai et al. ..... 84/637
5,656,790 A * 8/1997 Adachi ..... 84/601
5,850,051 A * 12/1998 Machover et al. ..... 84/634
RE36,910 E 10/2000 Nakata
2002/0023529 A1* 2/2002 Kurakake et al. ..... 84/610
2004/0055442 A1* 3/2004 Terada ..... 84/601
2004/0094020 A1* 5/2004 Wang et al. ..... 84/622

FOREIGN PATENT DOCUMENTS

JP 61-292691 12/1986
JP 4147192 5/1992
JP 2000-352977 12/2000
JP 2004-020796 1/2004

* cited by examiner

*Primary Examiner*—Marlon T Fletcher
(74) *Attorney, Agent, or Firm*—Morrison & Foerster LLP

(57) ABSTRACT

An automatic accompaniment apparatus that enables an external electronic musical instrument connected thereto to exhibit its accompaniment information generating capability to the maximum. Control information for causing an accompaniment information generator of the external electronic musical instrument to generate accompaniment information is generated and transmitted to the accompaniment information generator of the external electronic musical instrument via a control interface that connects to the external electronic musical instrument and performs transmission and reception of information to and from the external electronic musical instrument.

13 Claims, 9 Drawing Sheets

| TIMING | EVENT |
|---|---|
| 0000 | C2 NOTE ON VELOCITY72 |
| 0480 | C2 NOTE OFF |
| 0960 | G2 NOTE ON VELOCITY72 |
| 1440 | G2 NOTE OFF |

AUTOMATIC ACCOMPANIMENT APPARATUS, METHOD OF CONTROLLING THE SAME, AND PROGRAM FOR IMPLEMENTING THE METHOD

BACKGROUND OF THE INVENTION

1. Field of the Invention

The present invention relates to an automatic accompaniment apparatus and a method of controlling the same that connect an external electronic musical instrument to the apparatus and generate accompaniments via the external electronic musical instrument, as well as a program for implementing the method.

2. Description of the Related Art

Conventionally, an automatic accompaniment apparatus that connects an external electronic musical instrument thereto and generates accompaniments via the external electronic musical instrument has been known.

As an example of such an automatic accompaniment apparatus, there has been proposed an automatic accompaniment apparatus that connects thereto a musical tone generating apparatus (electronic musical instrument), which does not have an automatic accompaniment function, and generates an accompaniment via the musical tone generating apparatus by transmitting accompaniment information generated by the automatic accompaniment apparatus to the musical tone generating apparatus (see Japanese Laid-Open Patent Publication (Kokai) No. S61-292691, for example).

In the above conventional automatic accompaniment apparatus, however, generation of accompaniment information is carried out by the automatic accompaniment apparatus whereas sounding of accompaniment tones is carried out by the external electronic musical instrument. Thus, not accompaniment data stored in the external electronic musical instrument but accompaniment data stored in the automatic accompaniment apparatus is used as accompaniment data (for example, accompaniment style data) in generating accompaniment information. Therefore, even if accompaniment data stored in the external electronic musical instrument is richer in terms of music than accompaniment data stored in the automatic accompaniment apparatus, accompaniment information is generated using the accompaniment data stored in the automatic accompaniment apparatus, and hence the generated accompaniment information does not enable the external electronic musical instrument to exhibit its accompaniment information generating capability to the maximum.

Also, it is necessary to assume that all kinds of external electronic musical instruments from low to high accompaniment information generating capabilities are connectable to the above conventional automatic accompaniment apparatus, and hence accompaniment data to be stored in the conventional automatic accompaniment apparatus must be intended for general purpose use. Accompaniment information generated by this kind of automatic accompaniment apparatus cannot enable the external electronic musical instrument connected thereto to exhibit its accompaniment information generating capability to the maximum even if an external musical instrument with a higher accompaniment information generating capability is connected to the automatic accompaniment apparatus.

SUMMARY OF THE INVENTION

It is an object of the present invention to provide an automatic accompaniment apparatus and a method of controlling the same that enable an external electronic musical instrument connected to the apparatus to exhibit its accompaniment information generating capability to the maximum, as well as a program for implementing the method.

To attain the above object, in a first aspect of the present invention, there is provided an automatic accompaniment apparatus comprising a connecting device that connects to an external electronic musical instrument having an accompaniment information generating device and performs transmission and reception of information to and from the external electronic musical instrument, a control information generating device that generates control information for causing the accompaniment information generating device of the external electronic musical instrument to generate accompaniment information, and a transmitting device that transmits the control information generated by the control information generating device to the accompaniment information generating device of the external electronic musical instrument via the connecting device.

Here, in the case where the accompaniment information generating device of the external electronic musical instrument generates accompaniment information based on one piece of style data selected from an accompaniment style data group 110*a*, described later, appearing in FIG. 3, the control information generated by the control information generating device is comprised of style designation information, section designation information, chord designation information, start information, stop information, synchronization information (reproducing position in terms of time), and so forth.

With the arrangement of the automatic accompaniment apparatus according to the first aspect of the present invention, control information for causing the accompaniment information generating device of the external electronic musical instrument to generate accompaniment information is generated and the generated control information is transmitted to the accompaniment information generating device of the external electronic musical instrument via the connecting device, to thereby generate the accompaniment information via the accompaniment information generating device. This enables the external electronic musical instrument, which is connected to the automatic accompaniment apparatus, to exhibit its accompaniment information generating capability to the maximum. In particular, in the case where the accompaniment information generating device of the external electronic musical instrument has a higher accompaniment information generating capability than the accompaniment information generating device of the automatic accompaniment apparatus, accompaniment information that is richer in terms of music can be generated.

Preferably, the automatic accompaniment apparatus further comprises an accompaniment information generating device that generates accompaniment information based on the generated control information, and a selecting device that selects one of the accompaniment information generating device and the accompaniment information generating device of the external electronic musical instrument, and the transmitting device is operable when the selecting device selects the accompaniment information generating device of the automatic accompaniment apparatus, to directly transmit the generated control information to the accompaniment information generating device of the automatic accompaniment apparatus, and the transmitting device is operable when the selecting device selects the accompaniment information generating device of the external electronic musical instrument, to transmit the generated control information to the accompaniment information generating device of the external electronic musical instrument via the connecting device.

More preferably, the automatic accompaniment apparatus further comprises a receiving device that receives apparatus information on the external electronic musical instrument via the connecting device, a determining device that determines respective accompaniment information generating capabilities of the accompaniment information generating device of the automatic accompaniment apparatus and the accompaniment information generating device of the external electronic musical instrument based on the apparatus information received by the receiving device, and a control device that controls the selecting device to select one of the accompaniment information generating device of the automatic accompaniment apparatus and the accompaniment information generating device of the external electronic musical instrument, the one having been determined as having a higher accompaniment information generating capability by the determining device.

Here, examples of the apparatus information include information directly indicative of the accompaniment information generating capability (such as the number of parts to be generated and the number of tones to be sounded), information indicative of the accompaniment information generating capability in numerical form (such as a level of 1 to 10), and information indirectly indicative of the accompaniment information generating capability (such as the model of apparatus or the version of apparatus in the case of the same model). However, the comparison of the accompaniment information generating capability is difficult using the apparatus information indirectly indicative of the accompaniment information generating capability, and hence in this case, a database is searched based on the apparatus information so as to acquire information directly indicative of the accompaniment information generating capability. This database may be implemented by a database stored in the automatic accompaniment apparatus or a database stored in a server. The database stored in the server may be referred to via a communication I/F and a communication network.

Preferably, the automatic accompaniment apparatus further comprises an accompaniment information generating device that generates accompaniment information based on the generated control information, and a receiving device that receives data based on which accompaniment information is to be generated, via the connecting device, and the data is stored in the external electronic musical instrument, and the accompaniment information generating device of the automatic accompaniment apparatus generates accompaniment information based on the data received by the receiving device and the generated control information.

To attain the above object, in a second aspect of the present invention, there is provided a method of controlling an automatic accompaniment apparatus, comprising a control information generating step of generating control information for causing an accompaniment information generating device of an external electronic musical instrument to generate accompaniment information, and a transmitting step of transmitting the control information generated in the control information generating step to the accompaniment information generating device of the external electronic musical instrument via a connecting device that connects to the external electronic musical instrument and performs transmission and reception of information to and from the external electronic musical instrument.

According to the second aspect of the present invention, the same effects as those obtained by the automatic accompaniment apparatus according to the first aspect can be obtained.

To attain the above object, in a third aspect of the present invention, there is provided a program for causing a computer to execute a method of controlling an automatic accompaniment apparatus, comprising a control information generating module for generating control information for causing an accompaniment information generating device of an external electronic musical instrument to generate accompaniment information, and a transmitting module for transmitting the control information generated by the control information generating module to the accompaniment information generating device of the external electronic musical instrument via a connecting device that connects to the external electronic musical instrument and performs transmission and reception of information to and from the external electronic musical instrument.

According to the third aspect of the present invention, the same effects as those obtained by the automatic accompaniment apparatus according to the first aspect can be obtained.

The above and other objects, features, and advantages of the invention will become more apparent from the following detained description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
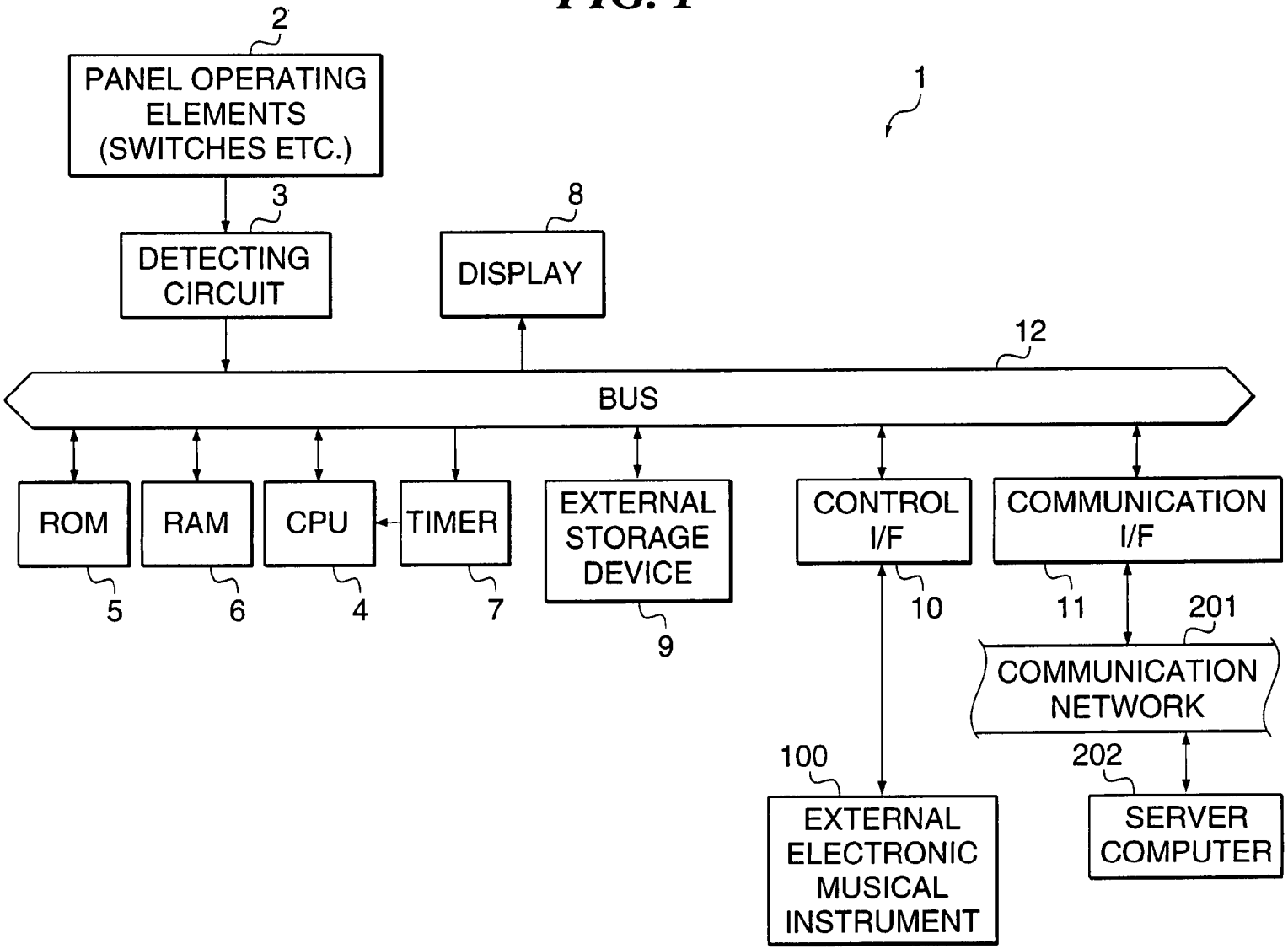
FIG. 1 is a block diagram schematically showing the construction of an automatic accompaniment apparatus according to a first embodiment of the present invention.

FIG. 1 is a block diagram schematically showing the construction of an automatic accompaniment apparatus 1 according to a first embodiment of the present invention.

As shown in FIG. 1, the automatic accompaniment apparatus 1 is comprised of panel operating elements 2 including a plurality of switches and a numeric keypad for inputting various information; a detecting circuit 3 for detecting operative states of the panel operating elements 2; a CPU 4 that controls the entire apparatus; a ROM 5 that stores control programs to be executed by the CPU 4, various table data, etc.; a RAM 6 for temporarily storing accompaniment information, various input information, computation results, etc.; a timer 7 that measures an interrupt time for timer interrupt processing and various kinds of time; a display 8 comprised of a liquid crystal display (LCD), light emitting diodes (LEDs), etc., for displaying various information and others; an external storage device 9 that stores various application programs including control programs, various musical composition data, various other data, etc.; a control interface (I/F) 10 that receives control information from external devices and outputs control information to external devices; and a communication interface (I/F) 11 that performs transmission and reception of data to and from, for example, a server computer (hereinafter merely referred to as "the server") 202 via a communication network 201.

The above component elements 3 to 11 are connected to one another via a bus 12. The timer 7 is connected to the CPU 4, an external electronic musical instrument 100 to the control I/F 10, and the communication network 201 to the communication I/F 11. Here, the communication I/F 11 and the communication network 201 should not necessarily be wired, but may be wireless. Alternatively, one may be wired and the other may be wireless.

The external storage device 9 may be implemented by, for example, a flexible disk drive (FDD), a hard disk drive (HDD), a CD-ROM drive, or a magneto-optical disk drive (MO). The external storage device 9 may store the control programs to be executed by the CPU 4 as mentioned above. If one or more of the control programs are not stored in the ROM 5, the control program(s) may be stored in the external storage device 9, and by reading out the control program(s) from the external storage device 9 and storing the same in the RAM 6, the CPU 4 can operate in the same manner as if the control program(s) were stored in the ROM 5. This enables adding control programs and upgrading the version of the control programs with ease.

Although in the present embodiment, the control I/F 10 is implemented by a MIDI (musical instrument digital interface) that inputs and outputs MIDI messages, the present invention is not limited to this, but the control I/F 10 may be implemented by a universal interface such as RS-232C, USB (universal serial bus), or IEEE1394. In this case, data other than MIDI message data may be transmitted and received simultaneously via the control I/F 10.

As mentioned above, the communication I/F 11 is connected to the communication network 201 which may be a LAN (local area network), the Internet, a telephone line, or the like, for connection to the server 202 via the communication network 201. When one or more of the above programs and various parameters are not stored in the external storage device 9, the communication I/F 11 is used to download such program(s) and parameters from the server 202. The automatic accompaniment apparatus 1 as a client transmits a command or commands for downloading one or more programs and parameters to the server 202 via the communication I/F 11 and the communication network 201. In response to the command(s), the server 202 distributes the requested program(s) and parameters to the automatic accompaniment apparatus 1 via the communication network 201, and the automatic accompaniment apparatus 1 receives the program (s) and parameters via the communication I/F 11 and stores them in the external storage device 9, thus completing the download.

Although in the present embodiment, the automatic accompaniment apparatus 1 is constructed on a dedicated apparatus, the present invention is not limited to this, but the automatic accompaniment apparatus 1 may be constructed on a general-purpose personal computer by running an automatic accompaniment program thereon.

Figure 2:
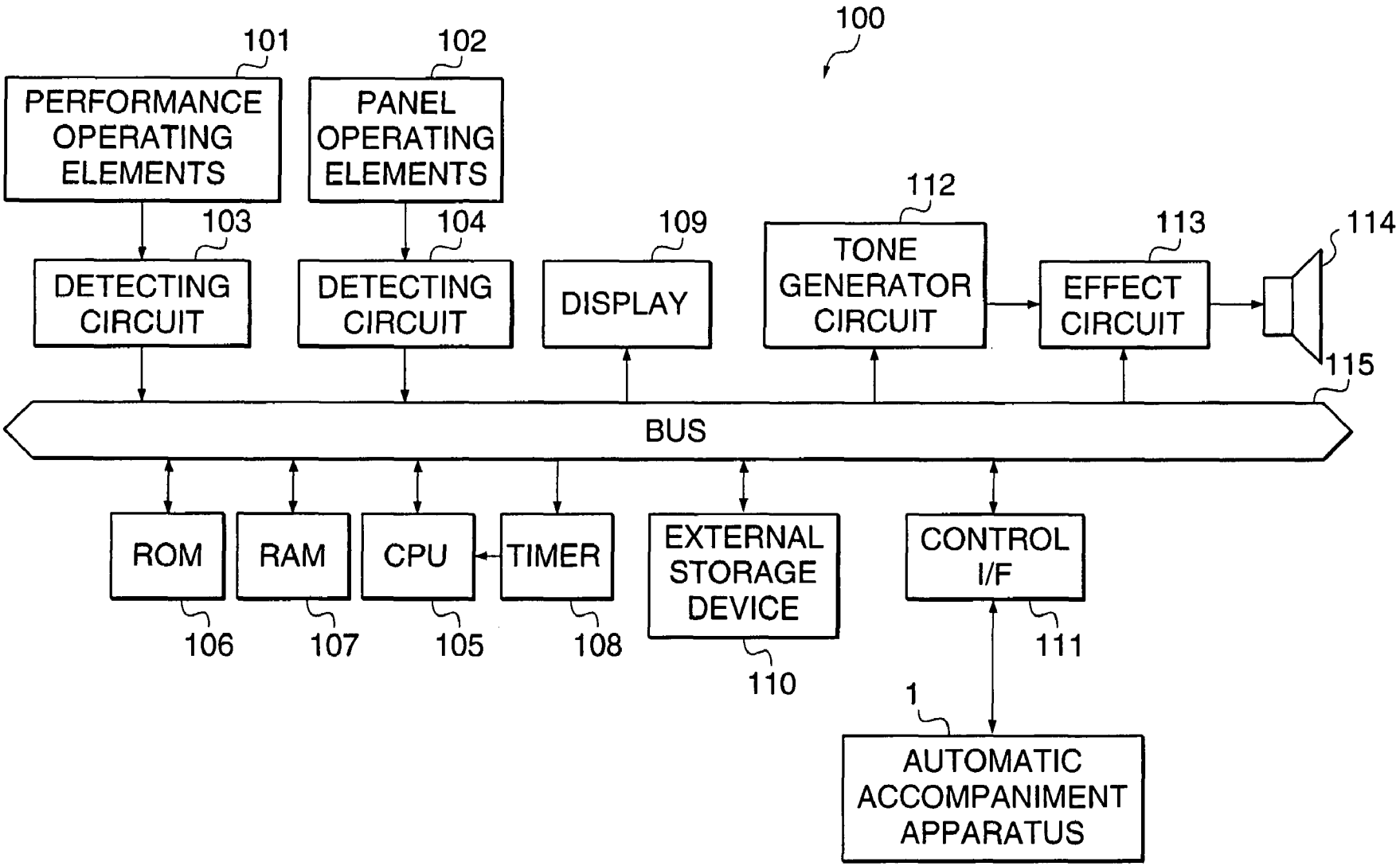
FIG. 2 is a block diagram schematically showing the construction of an external electronic musical instrument appearing in FIG. 1.

FIG. 2 is a block diagram schematically showing the construction of the external electronic musical instrument 100 mentioned above.

As shown in FIG. 2, the external electronic music apparatus 100 is comprised of performance operating elements 101 including a keyboard for inputting pitch information; panel operating elements 102 including a plurality of switches and a numeric keypad for inputting various information; a detecting circuit 103 for detecting operative states of the performance operating elements 101; a detecting circuit 104 for detecting operative states of the panel operating elements 102; a CPU 105 that controls the entire apparatus; a ROM 106 that stores control programs to be executed by the CPU 105, various table data, etc.; a RAM 107 for temporarily storing accompaniment information, various input information, computation results, etc.; a timer 108 that measures an interrupt time for timer interrupt processing and various kinds of time; a display 109 comprised of an LCD, LEDs, etc., for displaying various information; an external storage device 110 that stores various application programs including control programs, various musical composition data, various other data, etc.; a control I/F 111 that inputs control information from external devices and outputs control information to external devices; a tone generator circuit 112 that converts performance information input by the performance operating elements 101, generated accompaniment information, etc. into musical tone signals; an effect circuit 113 that applies various effects to musical tone signals from the tone generator circuit 112; and a sound system 114 that converts musical tone signals from the effect circuit 113 into sounds and is comprised of a DAC (digital-to-analog converter), an amplifier, a speaker, etc.

The above component elements 103 to 113 are connected to one another via a bus 115. The timer 108 is connected to the CPU 105, the automatic accompaniment apparatus 1 to the control I/F 111, the effect circuit 113 to the tone generator circuit 112, and the sound system 114 to the effect circuit 113.

The external storage device 110 may be implemented by, for example, an FDD, an HDD, a CD-ROM drive, or an MO drive. The external storage device 110 may store the control programs to be executed by the CPU 105 as mentioned above. If one or more of the control programs are not stored in the ROM 106, the control program(s) may be stored in the external storage device 110, and by reading out the control program(s) from the external storage device 110 and storing the same in the RAM 107, the CPU 105 can operate in the same manner as if the control program(s) were stored in the ROM 106. This enables adding control programs and upgrading the version of the control programs with ease.

Although in the present embodiment, the control I/F 110 is implemented by a MIDI as is the case with the control I/F 10 mentioned above, the present invention is not limited to this, but the control I/F 110 may be implemented by a universal interface such as RS-232C, USB, or IEEE1394. In this case, data other than MIDI message data may be transmitted and received simultaneously via the control I/F 111.

Although In the present embodiment, the external electronic musical apparatus 100 is a keyboard musical instrument type, but it may be a stringed instrument type, a wind instrument type, a percussion instrument type, or the like.

Further, the external electronic musical instrument 100 may be constructed on a dedicated apparatus other than an electronic musical instrument comprised of the minimum elements that can practice the present invention. Alternatively, the external electronic musical instrument 100 may be constructed on a general-purpose personal computer.

Further, although in the present embodiment, the automatic accompaniment apparatus 1 is not provided with a tone generator system (a tone generator circuit, an effect circuit, and a sound system) that generates musical tone signals to sound musical tones, it is quite a matter of course that the automatic accompaniment apparatus 1 may be provided with the tone generator system. Also, although in the present embodiment, the external electronic musical instrument 100 is not provided with a communication I/F, it is quite a matter of course that an electronic musical instrument provided with a communication I/F may be connected as an external electronic musical instrument to the control I/F 10 of the automatic accompaniment apparatus 1.

Figure 3:
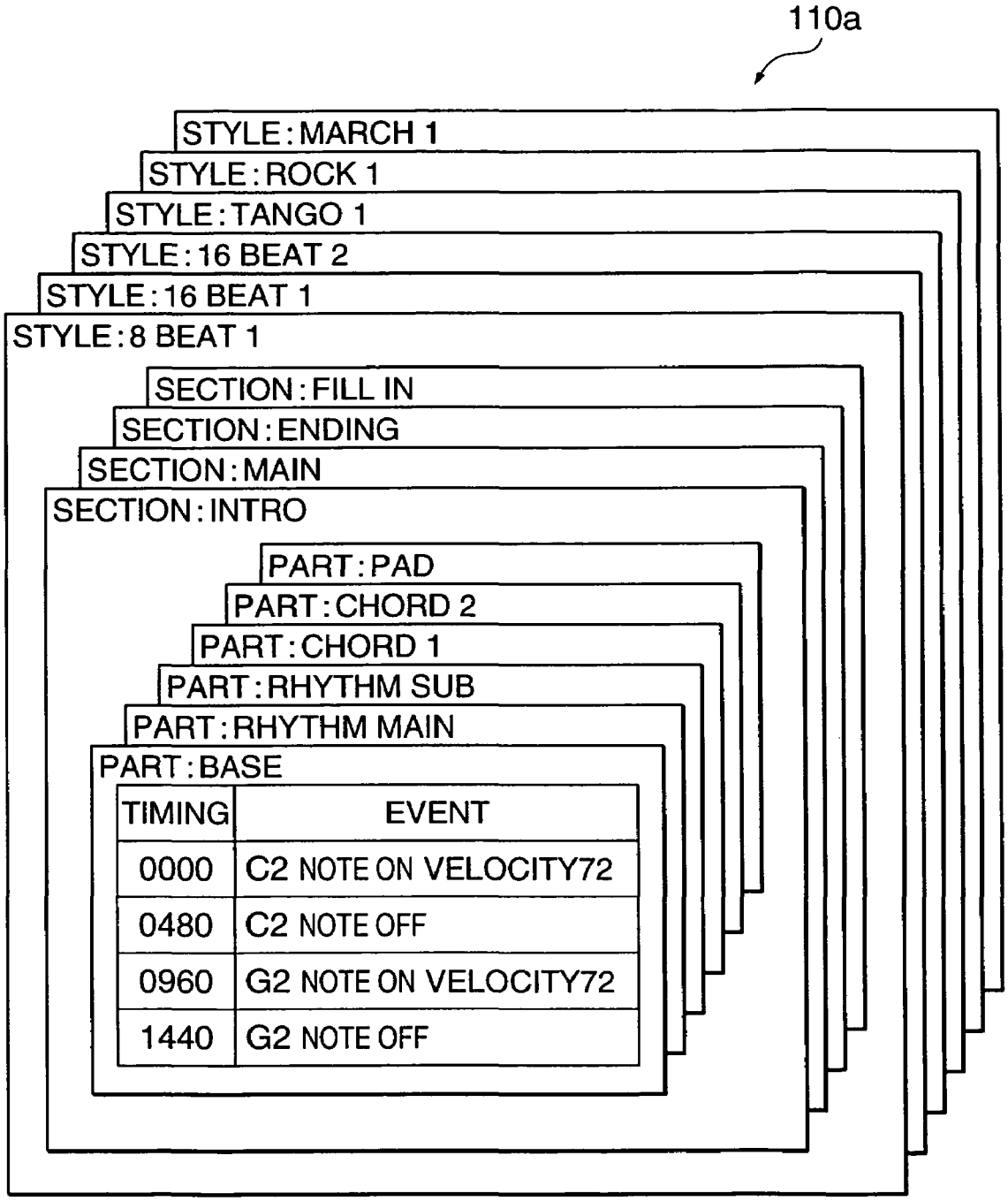
FIG. 3 is a diagram showing an example of accompaniment style data stored in an external storage device appearing in FIG. 2.

FIG. 3 is a diagram showing an example of an accompaniment style data group 110*a* stored in the external storage device 110 of the external electronic musical instrument 100, which generates accompaniment information for generating accompaniment tones based on one piece of style data selected from the accompaniment style data group 110*a*.

As shown in FIG. 3, the accompaniment style data group 110*a* is comprised of a plurality of pieces of style data corresponding to respective ones of a plurality of accompaniment styles, and each piece of the style data is comprised of a plurality of pieces of section data. The plurality of pieces of section data are comprised of section data suitable for use in "intro" of an accompaniment composition, section data suitable for use in "main" of the accompaniment music, section data suitable for use in "ending" of the accompaniment composition, and section data suitable for use as "fill in" of the accompaniment composition. Each piece of the section data is comprised of a plurality of pieces of part data, all of which are played in parallel in accordance with the tempo of the accompaniment composition. Each piece of the part data is comprised of an event list having a predetermined section length (for example, a length of one measure). Here, the event list means a list of a sequence of a plurality of sets each consisting of an event and timing for reproduction thereof. In the present embodiment, the pitch of each event in the event list is expressed with reference to the C major chord. Therefore, in generating accompaniment information, the pitch of each event is converted into a pitch suitable for designated chord information. The timing for reproduction of each event can be set in terms of "tick" (for example, 480 ticks=1 beat).

A detailed description will now be given of control processing carried out by the automatic accompaniment apparatus 1 constructed as described above with reference to FIGS. 4 and 5.

Figure 4:
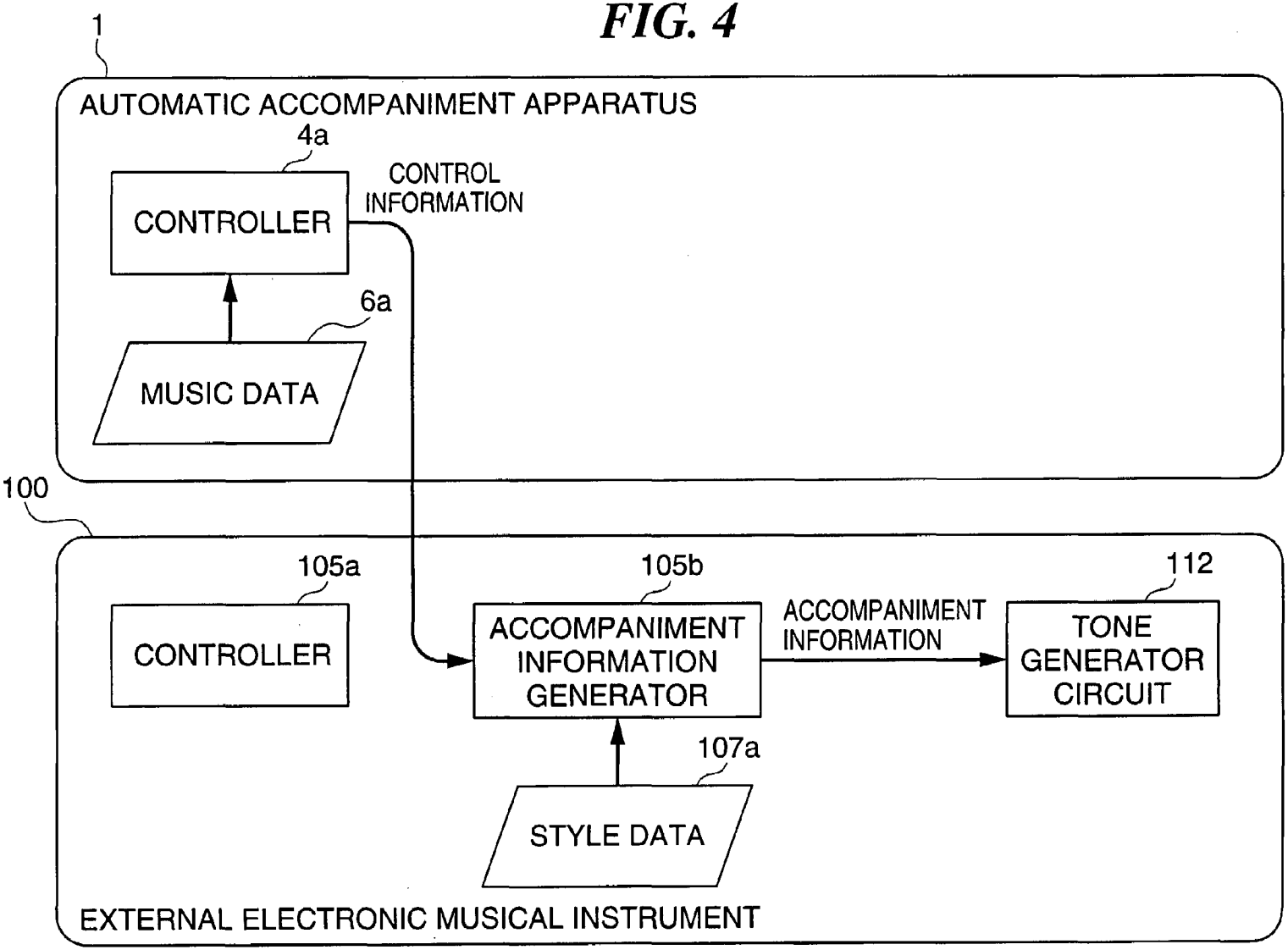
FIG. 4 is a block diagram showing the control system configurations of the automatic accompaniment apparatus in FIG. 1 and the external electronic musical instrument in FIG. 2.

FIG. 4 is a block diagram showing the control system configurations of the automatic accompaniment apparatus 1 and the external electronic musical instrument 100. It should be noted that in FIG. 4, there are shown only the configurations of elements and parts needed to explain the control processing carried out by the automatic accompaniment apparatus 1. Therefore, for example, although in FIG. 4, no accompaniment information generator is provided in the automatic accompaniment apparatus 1, this does not mean that the automatic accompaniment apparatus 1 is not provided with the accompaniment information generator.

Referring to FIG. 4, a controller 4*a* of the automatic accompaniment apparatus 1 shifts the value of a readout pointer indicative of a reading position of music data 6*a* one by one, for example, each time 1 tick has elapsed. If there is an event at the reading position of the music data 6*a* indicated by the readout pointer, the controller 4*a* reads out the event and generates control information based on the readout event. Here, in the hardware in FIG. 1, the controller 4*a* corresponds to the CPU 4, and the music data 6*a* corresponds to music data that is designated by a user from among a plurality of music data (such as music data for generating the melody of a piece of music) stored in the external storage device 9 and then read out and stored in a music data storage area, not shown, reserved at a predetermined location in the RAM 6.

Figure 5:
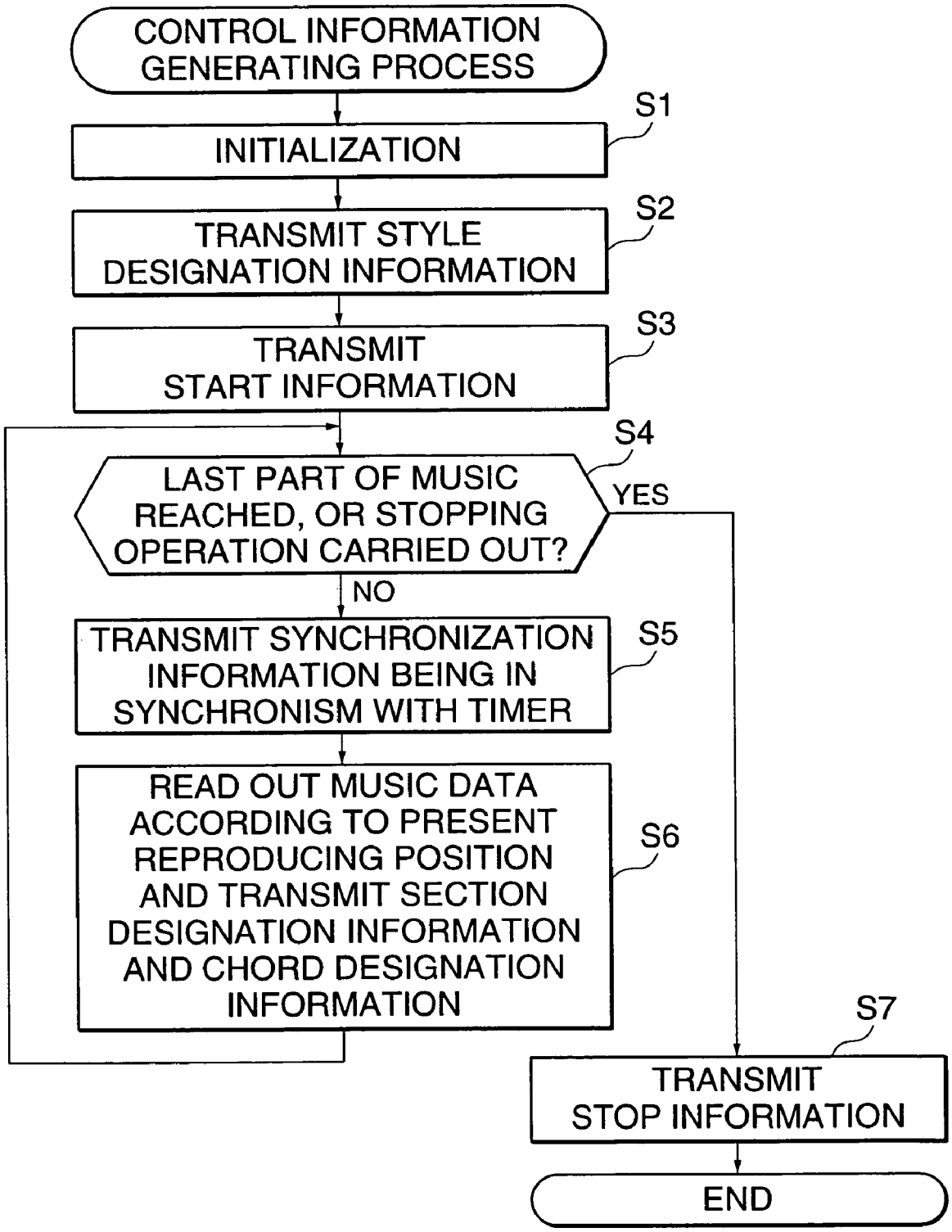
FIG. 5 is a flow chart showing the procedure of a control information generating process carried out by a controller of the automatic accompaniment apparatus appearing in FIG. 4.

FIG. 5 is a flow chart showing the procedure of a control information generating process carried out by the controller 4*a*. The control information generating process is started when the user designates an accompaniment style and gives an instruction for starting generation of accompaniment information through operation of one or more of the panel operating elements 2.

As shown in FIG. 5, first, initialization such as setting for interrupt processing to be performed by the timer 7 is carried out (step S1).

Next, information indicative of an accompaniment style designated by the user (style designation information) is transmitted to an accompaniment information generator 105*b* of the external electronic musical instrument 100 (step S2). The style designation information is converted into data in the form of a MIDI system exclusive message and transmitted to the external electronic musical instrument 100 via the control I/Fs 10 and 111. The style designation information thus transmitted is stored in a control information storage area, not shown, reserved at a predetermined location in the RAM 107 of the external electronic musical instrument 100.

Similarly, start information as well is transmitted to the accompaniment information generator 105*b* of the external electronic musical instrument 100 (step S3). The start information, however, is converted into data in the form of a start message as a MIDI real time message before it is transmitted.

Then, synchronization information being in synchronism with the timer 7 is transmitted to the accompaniment information generator 105*b* of the external electronic musical instrument 100 until the reading position indicated by the readout pointer reaches the trailing end of the music data 6*a* or until an instruction for stopping the generation of accompaniment information is given (step S5). Further, if there is an event of the music data 6*a* at the reading position indicated by the readout pointer, the event is read out, and in accordance with the contents of the readout event, section designation information and chord designation information are transmitted to the accompaniment information generator 105*b* of the external electronic musical instrument 100 (step S6). Here, the synchronization information is converted into data in the form of a timing clock message as a MIDI real time message before it is transmitted, and the section designation information and the chord designation information are each converted into data in the form of a MIDI system exclusive message before it is transmitted.

On the other hand, when the position indicated by the readout pointer reaches the trailing end of the music data 6*a* or when an instruction for stopping the generation of accompaniment information is given, stop information is transmitted to the accompaniment information generator 105*b* of the external electronic musical instrument 100 (step S7). Here, the stop information is converted into data in the form of a stop message as a MIDI real time message before it is transmitted.

Referring again to FIG. 4, the accompaniment information generator 105*b* (corresponding to the CPU 105 of the hardware in FIG. 2) of the external electronic musical instrument 100 generates accompaniment information based on the various control information transmitted from the controller 4*a* of the automatic accompaniment apparatus 1. Specifically, first, upon receiving the style designation information, the accompaniment information generator 105*b* reads out one piece of style data on a style corresponding to the style designation information from among a plurality of pieces of style data included in the accompaniment style data group 110*a* mentioned above and then stores the readout style data in a style data storage area, not shown, reserved at a predetermined location in the RAM 107. The one piece of style data stored in the style data storage area corresponds to style data 107*a* appearing in FIG. 4.

Next, upon receiving the start information, the accompaniment information generator 105*b* starts generating accompaniment information. The accompaniment information is generated by converting the pitch of each event in each part included in section data on a section (in the present embodiment, "intro", "main", "ending" or "fill in") corresponding to the received section designation information into a pitch suitable for the received chord designation information and reproducing each event with the converted pitch in timing set in association with the event. In many cases, however, leaving reproduction of each event exclusively to the accompaniment information generator 105*b* could cause a difference between timing in which each event of the music data 6*a* is read out and timing in which accompaniment information is generated, and hence generation of accompaniment information is carried out based on the received synchronization information.

The accompaniment information generator 105*b* transmits the accompaniment information thus generated to the tone generator circuit 112. The tone generator circuit 112 generates musical tone signals based on the received accompaniment information and then transmits the same to the effect circuit 113 and the sound system 114.

As described above, according to the present embodiment, accompaniment information is generated using the accompaniment information generator 105*b* of the external electronic musical instrument 100 by transmitting control information to the external electronic musical instrument 100 to control the accompaniment information generator 105*b* of the external electronic musical instrument 100. Therefore, it is possible to generate accompaniment information that enables the external electronic musical instrument 100 to exhibit the accompaniment information generating capability to the maximum. In particular, in the case where the accompaniment information generator 105*b* of the external electronic musical instrument 100 has a higher accompaniment information generating capability as compared with the accompaniment information generator of the automatic accompaniment apparatus 1, accompaniment information that is richer in terms of music can be generated. Specifically, examples of such richer accompaniment information include accompaniment information that is superior in the number of parts, the number of tones to be sounded, the precision of pitch and volume control, the number of variations, and so forth.

Next, a description will be given of an automatic accompaniment apparatus 1' according to a second embodiment of the present invention.

The automatic accompaniment apparatus 1' according to the second embodiment differs from the automatic accompaniment apparatus 1 according to the first embodiment only in the procedure of control processing, and hence the same hardware as that of the automatic accompaniment apparatus 1, i.e. the hardware in FIG. 1 is used as it is. For the external electronic musical instrument 100, the hardware in FIG. 2 is used as it is.

Figure 6:
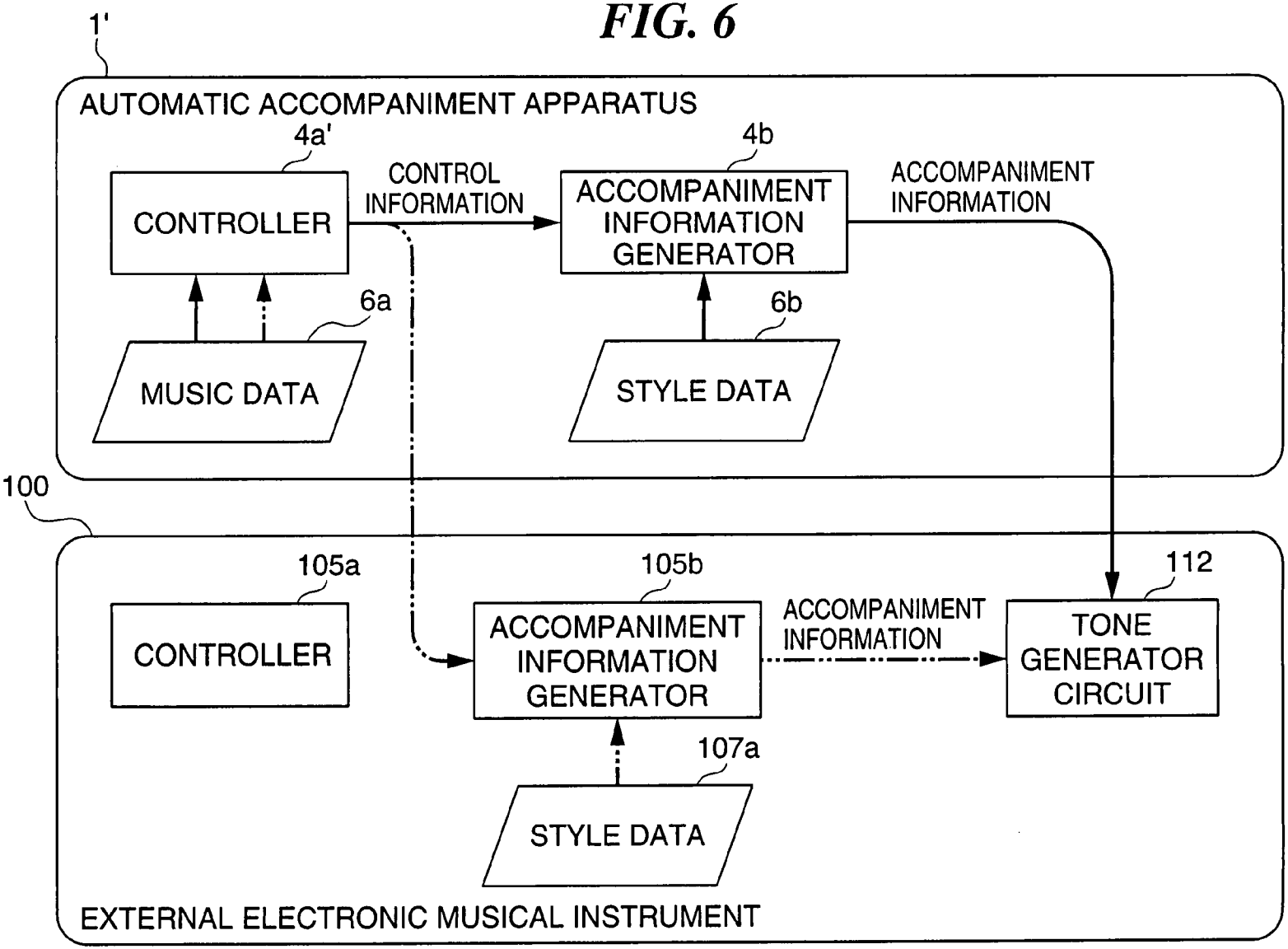
FIG. 6 is a block diagram showing the control system configurations of an automatic accompaniment apparatus and an external electronic musical instrument according to a second embodiment of the present invention.

FIG. 6 is a block diagram showing the control system configurations of the automatic accompaniment apparatus 1' according to the present embodiment and the external electronic musical instrument 100. In FIG. 6, elements and parts corresponding to those appearing in FIG. 4 are denoted by the same numerals, and description thereof is omitted.

As shown in FIG. 6, the automatic accompaniment apparatus 1' includes an accompaniment information generator 4*b*. A controller 4*a'* of the automatic accompaniment apparatus 1' compares the accompaniment information generating capability of the accompaniment information generator 4*b* and the accompaniment information generating capability of the accompaniment information generator 105*b* of the external electronic musical instrument 100 with each other to determine which has a higher accompaniment information generating capability and then generates accompaniment information using the accompaniment information generator with a higher accompaniment information generating capability.

Figure 7:
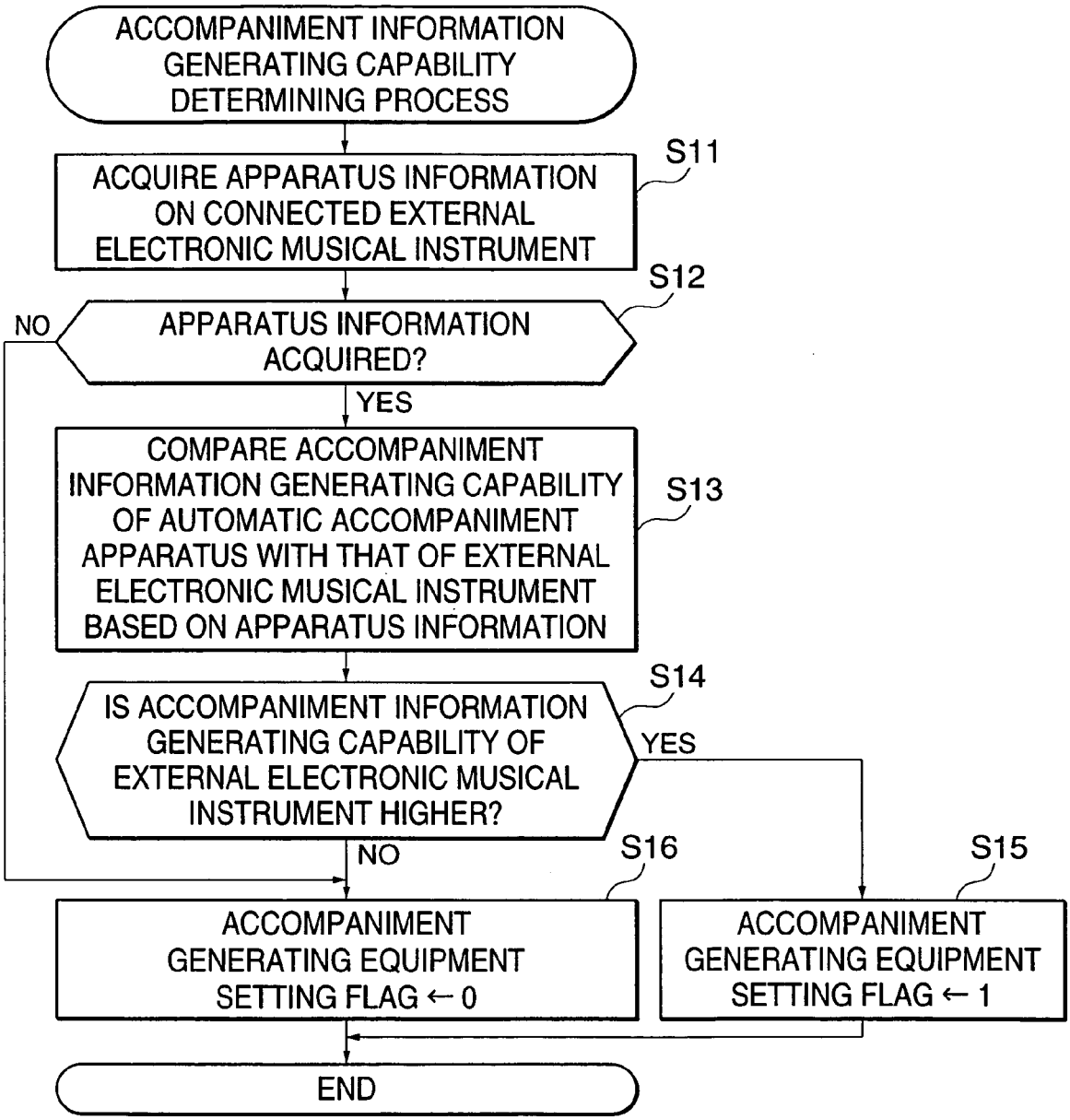
FIG. 7 is a flow chart showing the procedure of an accompaniment information generating capability determining process carried out by a controller of the automatic accompaniment apparatus appearing in FIG. 6.

FIG. 7 is a flow chart showing an accompaniment information generating capability determining process carried out by the controller 4*a'*. The accompaniment information generating capability determining process is carried out before generation of accompaniment information is started, i.e. when the user turns on power to the external electronic musical instrument 100 or when the user designates an accompaniment style through operation one or more of the panel operating elements 2.

As shown in FIG. 7, first, apparatus information on the external electronic musical instrument 100 connected to the automatic accompaniment apparatus 1' is acquired (step S11). Specifically, the controller 4*a'* transmits a MIDI device inquire message to the external electronic musical instrument 100 via the control I/F 10. Responsive to this, the external electronic musical instrument 100 transmits response information including apparatus information on itself to the automatic accompaniment apparatus 1'.

Next, the controller 4*a'* waits for the response information from the external electronic musical instrument 100, and upon acquiring the response information, the controller 4*a'* compares the accompaniment information generating capability of the automatic accompaniment apparatus 1' and the accompaniment information generating capability of the external electronic musical instrument 100 with each other based on the apparatus information on the external electronic musical instrument 100, which is included in the response information (step S13). Here, examples of the apparatus information acquired include information directly indicative of the accompaniment information generating capability (such as the number of parts to be generated and the number of tones to be sounded), information indicative of the accompaniment information generating capability in numerical form (such as a level of 1 to 10), and information indirectly indicative of the accompaniment information generating capability (such as the model of apparatus or the version of apparatus in the case of the same model). However, the comparison of accompaniment information generating capability is difficult using the apparatus information indirectly indicative of the accompaniment information generating capability, and hence in this case, a database is searched based on the apparatus information so as to acquire information directly indicative of the accompaniment information generating capability. This database may be implemented by a database stored in the automatic accompaniment apparatus 1' or a database stored in a server 202. The database stored in the server 202 may be referred to via the communication I/F 11 and the communication network 201.

If it is determined in the step S13 that the external electronic musical instrument 100 has a higher accompaniment information generating capability, for example, an accompaniment generating device setting flag reserved at a predetermined location in the RAM 6 is set (to "1") so as to set the accompaniment information generator 105*b* of the external electronic musical instrument 100 for use. On the other hand, if it is determined in the step S13 that the automatic accompaniment apparatus 1' has a higher accompaniment information generating capability, the accompaniment generating device setting flag is reset (to "0") so as to set the accompaniment information generator 4*b* of the automatic accompaniment apparatus 1' for use.

The controller 4*a'* then carries out the same process as the control information generating process carried out by the controller 4*a* of the automatic accompaniment apparatus 1 according to the first embodiment described above, i.e. the control information generating process in FIG. 5 referred to earlier. In FIG. 5, however, in the processing in which designated control information is transmitted, i.e. in the steps S2, S3, S5, and S6, the accompaniment information generator 4*b* of the automatic accompaniment apparatus 1' or the accompaniment information generator 105*b* of the external electronic musical instrument 100 is selected depending on the status of the accompaniment generating device setting flag, and designated control information is transmitted to the selected one.

Figure 8:
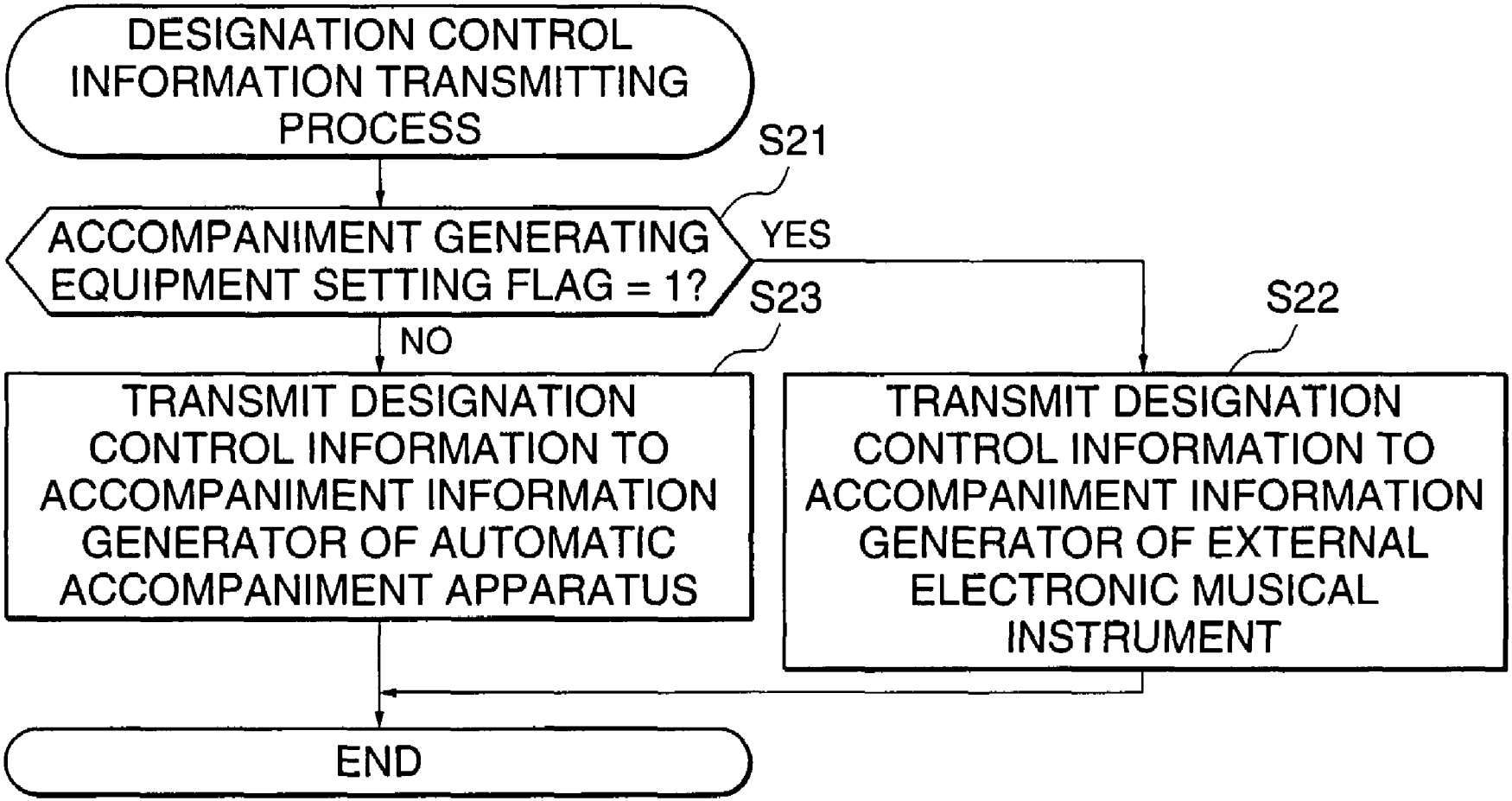
FIG. 8 is a flow chart showing the procedure of a designated control information transmitting process carried out by the controller of the automatic accompaniment apparatus appearing in FIG. 6.

FIG. 8 is a flow chart showing the procedure of a designated control information transmitting process. As shown in FIG. 8, first, the status of the accompaniment generating device setting flag is determined (step S21). When the accompaniment generating device setting flag assumes "1", the designated control information is transmitted to the accompaniment information generator 105*b* of the external electronic musical instrument 100 (step S22). On the other hand, when the accompaniment generating device setting flag assumes "0", the designated control information is transmitted to the accompaniment information generator 4*b* of the automatic accompaniment apparatus 1' (step S23).

As described above, according to the present embodiment, accompaniment information is generated using the accompaniment information generator with a higher accompaniment information generating capability. Therefore, accompaniment information that is richer in terms of music can be generated.

Although in the present embodiment, which accompaniment information generator has a higher accompaniment information generating capability is automatically determined and accompaniment information is generated using the accompaniment information generator having a higher accompaniment information generating capability, the present invention is not limited to this, but the result of the determination as to which accompaniment information generator has a higher accompaniment information generating capability may be presented to the user so that definitive selection of the accompaniment information generator that is to generate accompaniment information is left to the user. For example, a message "It is advisable to generate accompaniment information using the accompaniment information generating function of a connected external electronic musical instrument. Do you select the accompaniment information generating function of the external electronic musical instrument? (y/n)" is displayed on the display 8 so as to prompt the user to give an instruction.

A description will now be given of an automatic accompaniment apparatus 1" according to a third embodiment of the present invention.

The automatic accompaniment apparatus 1" according to the third embodiment differs from the automatic accompaniment apparatus 1 according to the first embodiment only in the procedure of control processing, and hence the same hardware as that of the automatic accompaniment apparatus 1, i.e. the hardware in FIG. 1 is used as it is. Also, the hardware in FIG. 2 is used as it is for the external electronic musical instrument 100.

Figure 9:
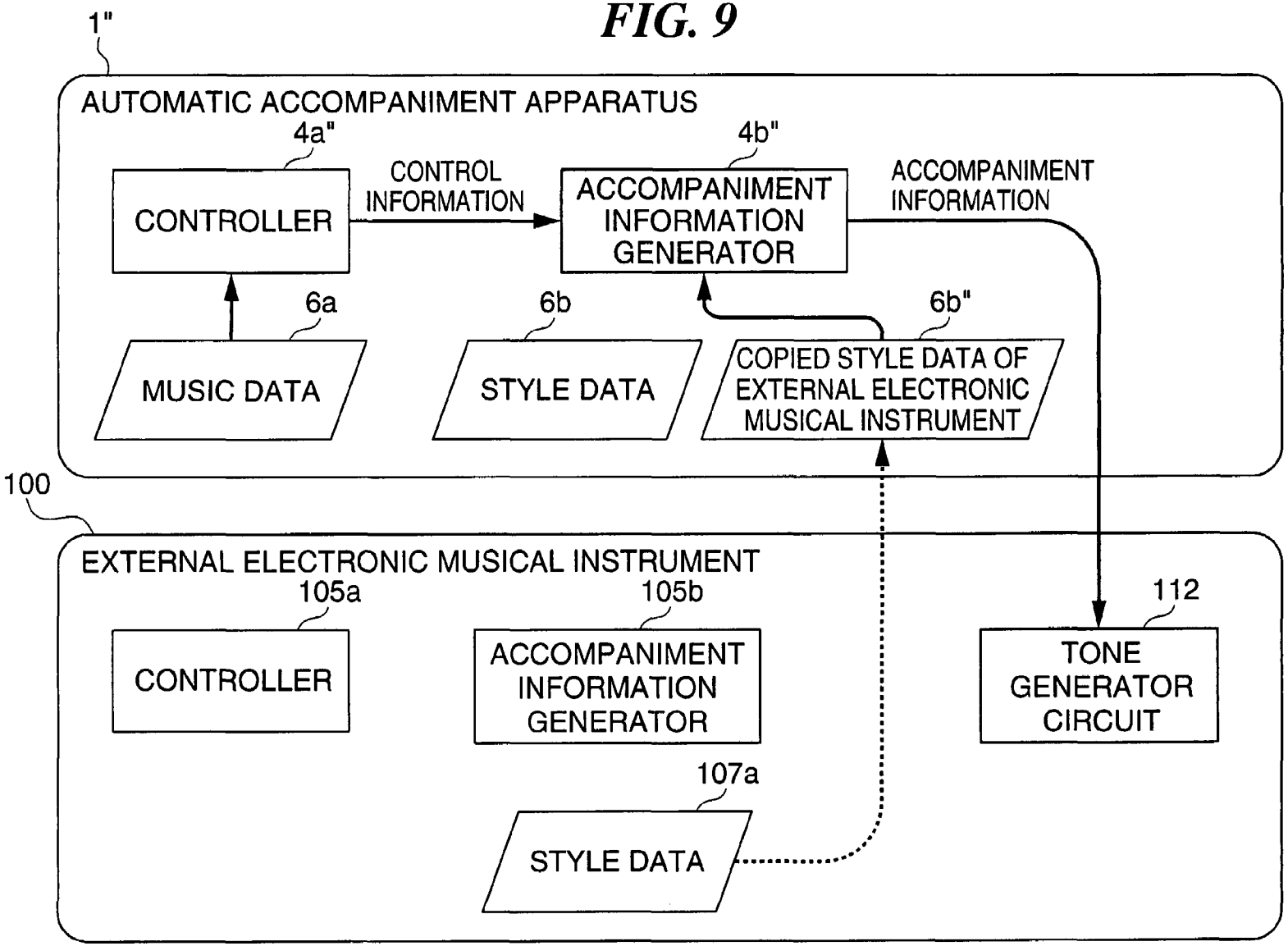
FIG. 9 is a block diagram showing the control system configurations of an automatic accompaniment apparatus and an external electronic musical instrument according to a third embodiment of the present invention.

FIG. 9 is a block diagram showing the control system configurations of the automatic accompaniment apparatus 1" according to the present embodiment and the external electronic musical instrument 100. In FIG. 9, elements and parts corresponding to those appearing in FIGS. 4 and 6 are denoted by the same reference numerals, and description thereof is omitted.

Referring to FIG. 9, a controller 4*a"* of the automatic accompaniment apparatus 1" transmits a MIDI system exclusive message to the external electronic musical instrument 100 via the control I/F 10. The system exclusive message includes a message that requests transmission of the style data 107*a* stored in the external electronic musical instrument to the automatic accompaniment apparatus 1". Upon receiving the message, a controller 105*a* of the external electronic musical instrument 100 transmits its style data 107*a* to the automatic accompaniment apparatus 1" via the control I/F 111.

The automatic accompaniment apparatus 1" receives the style data 107*a* via the control I/F 10 and stores the received style data 107*a* in an external electronic musical instrument style data storage area, not shown, reserved at a predetermined location, for example, in the RAM 6. The one piece of style data 107*a* stored in the external electronic musical instrument style data storage area corresponds to style data 6*b"* appearing in FIG. 9.

An accompaniment information generator 4*b"* of the automatic accompaniment apparatus 1" generates accompaniment information using the style data 6*b"*.

As described above, according to the present embodiment, accompaniment information is generated using the style data 107*a* stored in the external electronic musical instrument 100. Therefore, accompaniment information that is richer in terms of music can be generated in the case where the style data 107*a* of the external electronic musical instrument 100 is richer than the style data 6*b* stored in the automatic accompaniment apparatus 1".

Although in the above described embodiments, various control information transmitted to the accompaniment information generators 105*b*, 4*b*, and 4*b"* are data in the form of MIDI messages, the present invention is not limited to this.

Also, although the above described embodiments are intended exclusively to generate accompaniment information, they may be intended to generate performance information of a melody.

Further, although in the above described embodiments, the tone generator circuit is provided in the external electronic musical instrument and is used to convert generated accompaniment information into musical tone signals, the tone generator circuit should not necessarily be provided in the external electronic musical instrument, but may be provided in the automatic accompaniment apparatus, or a tone generator circuit externally connected to the automatic accompaniment apparatus and/or the external electronic musical instrument may be used.

It is to be understood that the object of the present invention may also be accomplished by supplying a system or an apparatus with a storage medium in which a program code of software, which realizes the functions of any of the above described embodiments is stored, and causing a computer (or CPU or MPU) of the system or apparatus to read out and execute the program code stored in the storage medium.

In this case, the program code itself read from the storage medium realizes the functions of any of the above described embodiments, and hence the program code and a storage medium on which the program code is stored constitute the present invention.

Examples of the storage medium for supplying the program code include a floppy (registered trademark) disk, a hard disk, a magneto-optical disk, an optical disk such as a CD-ROM, a CD-R, a CD-RW, a DVD-ROM, a DVD-RAM, a DVD-RW, and a DVD+RW, a magnetic tape, a nonvolatile memory card, and a ROM. Alternatively, the program code may be downloaded from a server computer via a communication network.

Further, it is to be understood that the functions of any of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of any of the above described embodiments may be accomplished by writing a program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. An automatic accompaniment apparatus comprising:

a connecting device that connects to an external electronic musical instrument having an accompaniment information generating device and a storage device storing accompaniment-relevant style data, and that performs transmission and reception of information to and from the external electronic musical instrument;

a music data storage device that stores music data including events;

a timer that measures a time;

a control information generating device that reads out each event of the music data according to the measured time, generates, according to the read out event, control information for causing the accompaniment information generating device of the external electronic musical instrument to generate accompaniment information based on the style data stored in said storage device, said control information including synchronization information for synchronizing a time of the read out of each event of the music data by the automatic accompaniment apparatus and a time of the generation of the accompaniment information corresponding to each read out event by the external electronic musical instrument; and a transmitting device that transmits the control information generated by said control information generating device to the accompaniment information generating device of the external electronic musical instrument via said connecting device.

2. An automatic accompaniment apparatus according to claim 1, wherein said control information further includes section designation information and chord designation information.

3. An automatic accompaniment apparatus comprising:

a connecting device that connects to an external electronic musical instrument having an accompaniment information generating device, and performs transmission and reception of information to and from the external electronic musical instrument;

a control information generating device that generates control information for causing the accompaniment information generating device of the external electronic musical instrument to generate accompaniment information;

a transmitting device that transmits the control information generated by said control information generating device to the accompaniment information generating device of the external electronic musical instrument via said connecting device;

an accompaniment information generating device that generates accompaniment information based on the generated control information; and a selecting device that selects one of said accompaniment information generating device and the accompaniment information generating device of the external electronic musical instrument, and wherein said transmitting device is operable when said selecting device selects said accompaniment information generating device of the automatic accompaniment apparatus, to directly transmit the generated control information to said accompaniment information generating device of the automatic accompaniment apparatus, and said transmitting device is operable when said selecting device selects the accompaniment information generating device of the external electronic musical instrument, to transmit the generated control information to the accompaniment information generating device of the external electronic musical instrument via said connecting device.

4. An automatic accompaniment apparatus comprising:

a connecting device that connects to an external electronic musical instrument having an accompaniment information generating device, and performs transmission and reception of information to and from the external electronic musical instrument;

a control information generating device that generates control information for causing the accompaniment information generating device of the external electronic musical instrument to generate accompaniment information;

a transmitting device that transmits the control information generated by said control information generating device to the accompaniment information generating device of the external electronic musical instrument via said connecting device;

a receiving device that receives apparatus information of the external electronic musical instrument via said connecting device;

a determining device that determines respective accompaniment information generating capabilities of said accompaniment information generating device of the automatic accompaniment apparatus and the accompaniment information generating device of the external electronic musical instrument based on the apparatus information received by said receiving device; and a control device that controls said selecting device to select one of said accompaniment information generating device of the automatic accompaniment apparatus and the accompaniment information generating device of the external electronic musical instrument, the one having been determined as having a higher accompaniment information generating capability by said determining device.

5. An automatic accompaniment apparatus comprising:

a connecting device that connects to an external electronic musical instrument having an accompaniment information generating device, and performs transmission and reception of information to and from the external electronic musical instrument;

a control information generating device that generates control information for causing the accompaniment information generating device of the external electronic musical instrument to generate accompaniment information;

a transmitting device that transmits the control information generated by said control information generating device to the accompaniment information generating device of the external electronic musical instrument via said connecting device;

an accompaniment information generating device that generates accompaniment information based on the generated control information; and a receiving device that receives data based on which accompaniment information is to be generated, via said connecting device, the data being stored in the external electronic musical instrument, and wherein said accompaniment information generating device of the automatic accompaniment apparatus generates accompaniment information based on the data received by said receiving device and the generated control information.

6. A method of controlling an automatic accompaniment apparatus, comprising:

storing music data including events;

measuring a time;

reading out each event of the music data according to the measured time;

generating, according to the read out event, control information for causing an accompaniment information generating device of an external electronic musical instrument to generate accompaniment information based on style data stored in a storage device of the external electronic musical instrument, said control information including synchronization information for synchronizing a time of the read out of each event of the music data by the automatic accompaniment apparatus and a time of the generation of the accompaniment information corresponding to each read out event by the external electronic musical instrument; and transmitting the control information to the accompaniment information generating device of the external electronic musical instrument via a connecting device that connects to the external electronic musical instrument and performs transmission and reception of information to and from the external electronic musical instrument.

7. A computer-readable storage medium storing a computer-executable program for causing a computer to execute a method of controlling an automatic accompaniment apparatus, comprising:

storing music data including events;

measuring a time;

reading out each event of the music data according to the measured time;

generating, according to the read out event, control information for causing an accompaniment information generating device of an external electronic musical instrument to generate accompaniment information based on style data stored in a storage device of the external electronic musical instrument, said control information including synchronization information for synchronizing a time of the read out of each event of the music data by the automatic accompaniment apparatus and a time of the generation of the accompaniment information corresponding to each read out event by the external electronic musical instrument; and transmitting the control information to the accompaniment information generating device of the external electronic musical instrument via a connecting device that connects to the external electronic musical instrument and performs transmission and reception of information to and from the external electronic musical instrument.

8. A method of controlling an automatic accompaniment apparatus, comprising:

generating control information for causing an accompaniment information generating device of an external electronic musical instrument to generate accompaniment information;

selecting one of the automatic accompaniment apparatus and the external electronic musical instrument; and transmitting, when the automatic accompaniment apparatus is selected, the generated control information directly to an accompaniment information generating device of the automatic accompaniment apparatus, and transmitting, when the external electronic musical instrument is selected, the generated control information to the accompaniment information generating device of the external electronic musical instrument, wherein transmitting the generated control information to the accompaniment information generating device of the external electronic musical instrument is performed via a connecting device that connects to the external electronic musical instrument and performs transmission and reception of information to and from the external electronic musical instrument.

9. A method of controlling an automatic accompaniment apparatus, comprising:

generating control information for causing an accompaniment information generating device of an external electronic musical instrument to generate accompaniment information;

transmitting the control information to the accompaniment information generating device of the external electronic musical instrument via a connecting device that connects to the external electronic musical instrument and performs transmission and reception of information to and from the external electronic musical instrument;

receiving apparatus information of the external electronic musical instrument via said connecting device;

determining respective accompaniment information generating capabilities of said accompaniment information generating device of the automatic accompaniment apparatus and the accompaniment information generating device of the external electronic musical instrument based on the apparatus information; and selecting one of said accompaniment information generating device of the automatic accompaniment apparatus and the accompaniment information generating device of the external electronic musical instrument, based on a result of the determining that the one has a higher accompaniment information generating capability.

10. A method of controlling an automatic accompaniment apparatus, comprising:

generating control information for causing an accompaniment information generating device of an external electronic musical instrument to generate accompaniment information;

transmitting the control information to the accompaniment information generating device of the external electronic musical instrument via a connecting device that connects to the external electronic musical instrument and performs transmission and reception of information to and from the external electronic musical instrument;

receiving data from the external electronic musical instrument via said connecting device, wherein the data is based on which accompaniment information is to be generated, the data being stored in the external electronic musical instrument; and generating accompaniment information based on the received data and the control information, wherein the accompaniment information is generated by an accompaniment information generating device of the automatic accompaniment apparatus.

11. A computer-readable storage medium storing a computer-executable program for causing a computer to execute a method of controlling an automatic accompaniment apparatus, comprising:

generating control information for causing an accompaniment information generating device of an external electronic musical instrument to generate accompaniment information;

selecting one of the automatic accompaniment apparatus and the external electronic musical instrument; and transmitting, when the automatic accompaniment apparatus is selected, the generated control information directly to an accompaniment information generating device of the automatic accompaniment apparatus, and transmitting, when the external electronic musical instrument is selected, the generated control information to the accompaniment information generating device of the external electronic musical instrument, wherein transmitting the generated control information to the accompaniment information generating device of the external electronic musical instrument is performed via a connecting device that connects to the external electronic musical instrument and performs transmission and reception of information to and from the external electronic musical instrument.

12. A computer-readable storage medium storing a computer-executable program for causing a computer to execute a method of controlling an automatic accompaniment apparatus, comprising:

generating control information for causing an accompaniment information generating device of an external electronic musical instrument to generate accompaniment information;

transmitting the control information to the accompaniment information generating device of the external electronic musical instrument via a connecting device that connects to the external electronic musical instrument and performs transmission and reception of information to and from the external electronic musical instrument;

receiving apparatus information of the external electronic musical instrument via said connecting device;

determining respective accompaniment information generating capabilities of said accompaniment information generating device of the automatic accompaniment apparatus and the accompaniment information generating device of the external electronic musical instrument based on the apparatus information; and selecting one of said accompaniment information generating device of the automatic accompaniment apparatus and the accompaniment information generating device of the external electronic musical instrument, based on a result of the determining that the one has a higher accompaniment information generating capability.

13. A computer-readable storage medium storing a computer-executable program for causing a computer to execute a method of controlling an automatic accompaniment apparatus, comprising:

generating control information for causing an accompaniment information generating device of an external electronic musical instrument to generate accompaniment information;

transmitting the control information to the accompaniment information generating device of the external electronic musical instrument via a connecting device that connects to the external electronic musical instrument and performs transmission and reception of information to and from the external electronic musical instrument;

receiving data from the external electronic musical instrument via said connecting device, wherein the data is based on which accompaniment information is to be generated, the data being stored in the external electronic musical instrument; and generating accompaniment information based on the received data and the control information, wherein the accompaniment information is generated by an accompaniment information generating device of the automatic accompaniment apparatus.

* * * * *